US011013304B1

(12) United States Patent
Nygren

(10) Patent No.: US 11,013,304 B1
(45) Date of Patent: May 25, 2021

(54) EASE OF ACCESS WALLET INSERT ASSEMBLY

(71) Applicant: Gail Nygren, Victoria (CA)

(72) Inventor: Gail Nygren, Victoria (CA)

( * ) Notice: Subject to any disclaimer, the term of this patent is extended or adjusted under 35 U.S.C. 154(b) by 0 days.

(21) Appl. No.: 17/194,187

(22) Filed: Mar. 5, 2021

(51) Int. Cl.
*A45C 1/06* (2006.01)

(52) U.S. Cl.
CPC ..... *A45C 1/06* (2013.01); *A45C 2001/065* (2013.01)

(58) Field of Classification Search
CPC ..... A45C 1/06; A45C 2001/065
See application file for complete search history.

(56) References Cited

U.S. PATENT DOCUMENTS 2,432,557 A 12/1947 Broughton
2,827,093 A * 3/1958 Shenfield ..... A45C 1/08 150/112
3,483,909 A 12/1969 Osher et al.
3,543,825 A * 12/1970 Dobbs ..... A45C 1/08 150/113
D247,653 S 3/1978 Kamenstein
4,974,652 A 12/1990 Lemler
5,064,069 A * 11/1991 Su ..... B42F 7/08 206/425
D376,257 S 12/1996 Broussalian
D441,527 S * 5/2001 Hersh ..... D3/232
6,364,110 B2 * 4/2002 Johnson ..... A45C 3/00 190/901
6,796,344 B2 * 9/2004 Chen ..... A45C 1/024 150/113
6,837,368 B1 * 1/2005 Chang ..... G11B 33/0444 206/232
D510,800 S * 10/2005 Jakovljevic ..... D3/253
7,108,032 B1 9/2006 Whiteford et al.
D722,434 S * 2/2015 Bowen ..... D3/247
2003/0037851 A1 2/2003 Hogganvik
2005/0194273 A1 * 9/2005 Frankeny ..... A45C 1/06 206/311
2008/0023114 A1 * 1/2008 Bridgefarmer ..... A45C 1/06 150/147
2012/0261042 A1 * 10/2012 Khubani ..... A45C 13/005 150/143

FOREIGN PATENT DOCUMENTS

WO WO/2006/074485 7/2006

* cited by examiner

*Primary Examiner* — Robert Sandy
*Assistant Examiner* — David M Upchurch
(74) *Attorney, Agent, or Firm* — Carrie Stroup

(57) ABSTRACT

An easy access pocket insert assembly affixable within a wallet that does not have a separate zipper for coins, the insert comprising: an array of full-length pockets and two staggered rows of half-length pockets, to securely store and concurrently display a plurality of forms of payment. Each pocket is adjoined at sidewalls to neighbor pockets to create an accordion-like display, and to pull open the pockets for a user to insert their fingertips to easily remove payment. One full-length pocket may store unfolded paper currency next to a pocket storing coins to quickly count out cash payment; and if the user is short, to select a payment card. The height of the half-length pockets permits the top portion of the payment card to extend above the insert for easy viewing. When the wallet is closed, the compression on the insert assembly keeps the coins and cards from spilling out.

20 Claims, 7 Drawing Sheets

EASE OF ACCESS WALLET INSERT ASSEMBLY

TECHNICAL FIELD

The present invention pertains generally to wallets and methods for organizing cash and credit cards within the wallets. In particular, the present invention comprises an assembly for inserting into a wallet casing, in which the assembly is able to store a plurality of debit/credit cards, as well as storing monetary bills and coins, side-by-side for easy access, and to facilitate quickly counting out and extracting cash and card payments.

BACKGROUND OF THE INVENTION

Wallets currently on the market are very cumbersome. This is particularly frustrating when the user is holding other items and trying to pay for their purchases and move on from the cashier line in an expedient manner. The user cannot view at a glance and easily access all the various items enclosed in the wallet. The coin is particularly difficult to see and access in a narrow pocket which is zipped closed. Often the user must turn the wallet upside down and pour the coin out in her palm or on the counter to see what she has available. Because of this, she will often just use the bills and not bother with the coin, resulting in an excess of heavy coin in her wallet.

Another other popular option comprises having the coin compartment on the outside of the wallet, which prevents viewing of the coin and paper currency at the same time.

In addition, many of the wallets on the market are bulky, have zippers all around them, or flaps which need to be held out of the way or kept from flopping down and exposing credit cards, etc. The credit cards in those flaps (or inside the wallets) are often in overlapping slits in the material of the wallet and not easy to pull out.

What is needed in the wallet industry is an insert assembly able to co-locate a plurality of cards, monetary bills and coins, without zippers, pockets, or the like that require additional opening to access. A user should be able to open the wallet and concurrently view and access the cards, bills, and coins.

SUMMARY OF THE INVENTION

The various embodiments of the present invention comprise an assembly for insertion into a wallet "cover piece", to concurrently display for immediate access: currency (both coin and bills), debit/credit cards, gift cards, blank checks, and sales receipts, without the user having to move flaps, open zippers, flip the wallet around, etc. When the wallet is opened, all of the pockets with the different forms of payment expand to allow the user easy viewing and access, without having to slide the cards in/out of tight slots. When the wallet is closed, the pockets are compressed together, thus not requiring additional fixation mechanisms to seal them.

In an embodiment, the pocket insert assembly of the present invention comprises an array of full-length pockets and two staggered rows of half-length pockets, to securely store and concurrently display a plurality of forms of payment (i.e. content). Each pocket is adjoined at sidewalls to neighbor pockets to create a pivoted, accordion-like display on an insert top surface, and to pull the pockets open wide enough apart for a user to insert their fingertips to easily remove payment. One full-length pocket may store unfolded paper currency next to a pocket storing coins to quickly count out cash payment; and if the user is short, to select a payment card. The height of the half-length pockets permits the top portion of the payment card to extend above the insert for easy viewing. A wallet opened with the insert forms a substantially curved unit on a wallet bottom surface to facilitate holding in one hand, thus allowing the user to pay with the other hand.

The present invention further comprises a method of using a pocket insert assembly, comprising: providing an insert assembly comprising: a) an array of pockets arranged in an accordion-like, linear formation with a plurality of full-length pockets, and two rows of half-length pockets; b) each pocket comprising two thin substantially rectangular shaped sidewalls, joined to form an opened top surface, two side seams, a bottom seam; and each pocket sidewall affixed to an adjoining pocket sidewall; c) wherein the insert assembly in an expanded position stretches each pocket opened to concurrently display a contents stored within; d) wherein the insert assembly in a closed position is able to compress the pocket sidewalls together to securely store the contents within.

The method further comprises: affixing the insert assembly within a wallet cover piece comprising a substantially rectangular shaped stiff material, folded in half, with a fixation mechanism able to secure a wallet two opposing ends together; storing a plurality of the contents within the array of pockets; pivoting opening the wallet cover piece to concurrently display the contents, wherein a user extracts one or more of the contents by inserting a user's fingertips into the pockets; and closing the wallet cover piece by securing the fixation mechanism, wherein the array of pockets is compressed to securely store the contents.

In one or more embodiments, the assembly comprises: a plurality of "half-width" compartments (i.e. pockets) to hold cards; and at least two full width compartments co-located, in which one is for bills, and one is for coins.

In another embodiment, the assembly comprises at least one full-length pocket on each end, and a plurality of half-length pockets arranged into two staggered rows, in between the full-length pockets.

In another embodiment, the assembly comprises: two full-length pockets on one end (e.g. one for monetary bills, and one for coins); and, one or two full-length pockets on the opposing end, such as for shopping receipts and lists, blank checks, etc. The assembly further comprises two staggered rows of half-length sandwiched between the opposing full-length pockets (e.g. each row comprises 6, 8, etc. pockets).

An object of the present invention is to provide an easier, expeditious method of paying for items, such as in a supermarket checkout, by having all forms of payment and picture identification co-located for viewing, selection, and re-insertion. By seeing all forms of payment concurrently, a user can easily determine if they have enough cash, or if they need to pay with a debit/credit card or check. They can also easily determine if they have the exact change because of the co-location of the monetary bills in a pocket next to the coins. The coins are immediately viewable, such that a zipper does not need to be opened to access the coins.

Another object is to allow easy access to the wallet contents by not having flaps, zippers, different compartments located on the inside and outside of the wallet, etc. In the present invention, the user merely reaches into the assembly to pull-out the contents of any one pocket.

Another object is to enable the user easy withdrawing and inserting of payment forms. There is only one card per pocket, arranged in two rows. The user does not need to struggle with pulling the card out and re-inserting it because there is extra space on both the left and right sides of the card (about 2-4 mm) and an extra space to the front and back of each card that is able to fit a user's finger tips (about one quarter inch).

Another object is to enable easy viewing by having the pockets spread open and the cards extend about half an inch above the pocket top edge, and about half an inch space between two cards in the same row (for a total of two rows).

Another object is to provide an assembly in which objects stored within the assembly (e.g. cards, coin, bills, etc.) are not able to fall out of the wallet with the wallet is in a closed position.

Another object is to concurrently provide a display of all contents within the insert assembly when the wallet is opened, while keeping the contents from easily spilling out. The user is able to hold a wallet with the insert assembly of the present invention in one hand, and remove contents with their other hand, because the wallet and insert assembly form a stable, substantially flat plane, when opened.

Another object is provide an insert that when expanded it pull the pockets open wide enough apart for a user to insert their fingertips to easily remove payment.

Another object is to provide an assembly where the bills are stored without folding for easy viewing, counting, and to reduce the thickness of the wallet for easier handling.

Another object is to provide a mechanism of attaching the insert assembly of the present invention into a wallet cover via, e.g.: screwing or gluing the outer top edges of the insert into the wallet frame; or gluing or taping the insert onto the inner wall of the wallet cover.

These and other elements, features, steps, and advantages of the invention will be more readily understood upon consideration of the following detailed description of the invention, taken in conjunction with the accompanying drawings, in which presently preferred embodiments of the invention are illustrated by way of example, and in the claims. The various elements, features, steps, and combinations thereof that characterize aspects of the invention are pointed out with particularity in the claims annexed to and forming part of this disclosure. The invention does not necessarily reside in any one of these aspects taken alone, but rather in the invention taken as a whole.

BRIEF DESCRIPTION OF THE DRAWINGS

The teachings of the inventive art disclosed here are more readily understood by considering the drawings in conjunction with the written description including the claims, in which:

Figure 1:
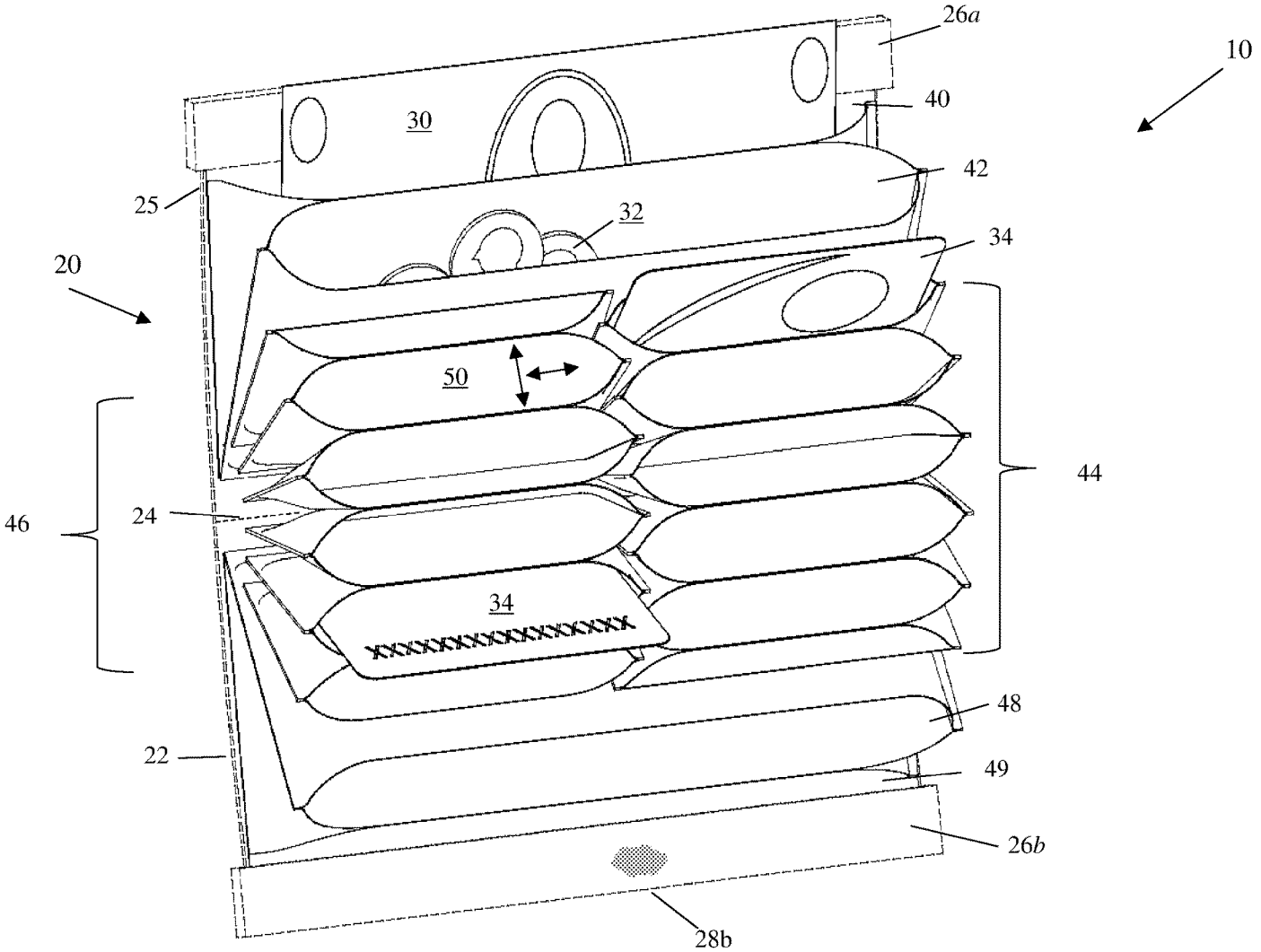
FIG. 1 illustrates a top view of the insert assembly of the present invention inside of a wallet cover piece, in an opened position forming a stable, substantially flat plane.

The drawing figures are not necessarily to scale. Direction of motion or coupling of views may be shown by bold arrows or boxed figures without further explanation where the meaning would be obvious to one skilled in the arts. Certain features or components herein may be shown in somewhat schematic form and some details of conventional elements may not be shown in the interest of clarity, explanation, or conciseness. It is to be expressly understood that the drawings are for illustration and description only and are not intended as a definition of the limits of the invention.

DETAILED DESCRIPTION

Although the following detailed description contains specific details for the purposes of illustration, one of skill in the art will appreciate that many variations and alterations to the following details are within the scope of the claimed invention.

In general, the pocket insert assembly of the present invention comprises an array or stack of pockets, in which each pocket is attached to the next pocket on its front and back sidewall. The array creates an expandable, compressable, pivotable (when ends are fixed), accordion-like unit, such as when a wallet having the array fixed within it is opened and closed.

In an embodiment, the assembly comprises at least one full-length pocket on each end, and a plurality of half-length pockets arranged into two staggered rows, in between the full-length pockets.

In an exemplary embodiment, insert assembly 10 comprises: two full-length pockets on one end (e.g. one for unfolded monetary bills, and one for coins); and, one or two full-length pockets on the opposing end, such as for shopping receipts and lists, blank checks, etc. Assembly 10 further comprises two staggered rows of half-length pockets sandwiched between the opposing full-length pockets (e.g. each row comprises 6, 8, etc. pockets). In one or more embodiments, each pocket is substantially rectangular shaped and is formed by two thin sheets of material, with an open top side, and a seam on the right and left, or inside and outside (half-length); and bottom sides. The half-length pockets are sufficiently long to house one card each: debit, credit, business, gift, etc. (e.g. about 3.25 inches long by 2.25 inches wide). The full-length pockets are sufficiently long to house a U.S. monetary bill (e.g. about 7 inches long by 2.5 inches deep).

TABLE 1

| Item Name | Number on FIGS. |
|---|---|
| Insert Assembly/Array | 10 |
| Wallet Cover Piece | 20 |
| Wallet Fold | 24 |
| Wallet Inner Surface | 25 |
| Paper currency | 30 |
| Coins | 32 |
| Payment Cards | 34 |
| $1^{st}$, $2^{nd}$ Full-Length Pocket | 40, 42 |
| $3^{rd}$, $4^{th}$ Full Length Pockets | 48, 49 |
| 2 Rows Half-length Pockets | 44, 46 |
| 2 Half-length, half-width Pockets | 70, 72 |
| 2 Flat Opposing End Walls | 60 |

TABLE 1-continued

| Item Name | Number on FIGS. |
|---|---|
| Holes to affix screws | 62 |
| Pocket sidewalls, seams, top | 50, 52, 54, 56, 58 |

As illustrated in FIGS. 1-7, and Table 1 item numbers, pocket insert assembly 10 combines an array of pockets (i.e. a plurality) that are easy to view, access, and securely store contents comprising one or more of the following content types, by way of non-limiting examples: coins, monetary bills, credit and debit cards, business cards, a few individual blank checks, and miscellaneous items such as shopping receipts and parking chits. When the array is extended open, all of the pockets concurrently or simultaneously display the contents stored within so a user can easily pick the correct form of payment.

Insert assembly 10 is made of thin (about 1-3 millimeters thick) slightly flexible to stiff material, e.g. plastic, which is transparent, solid colored, or opaque.

Figure 7:
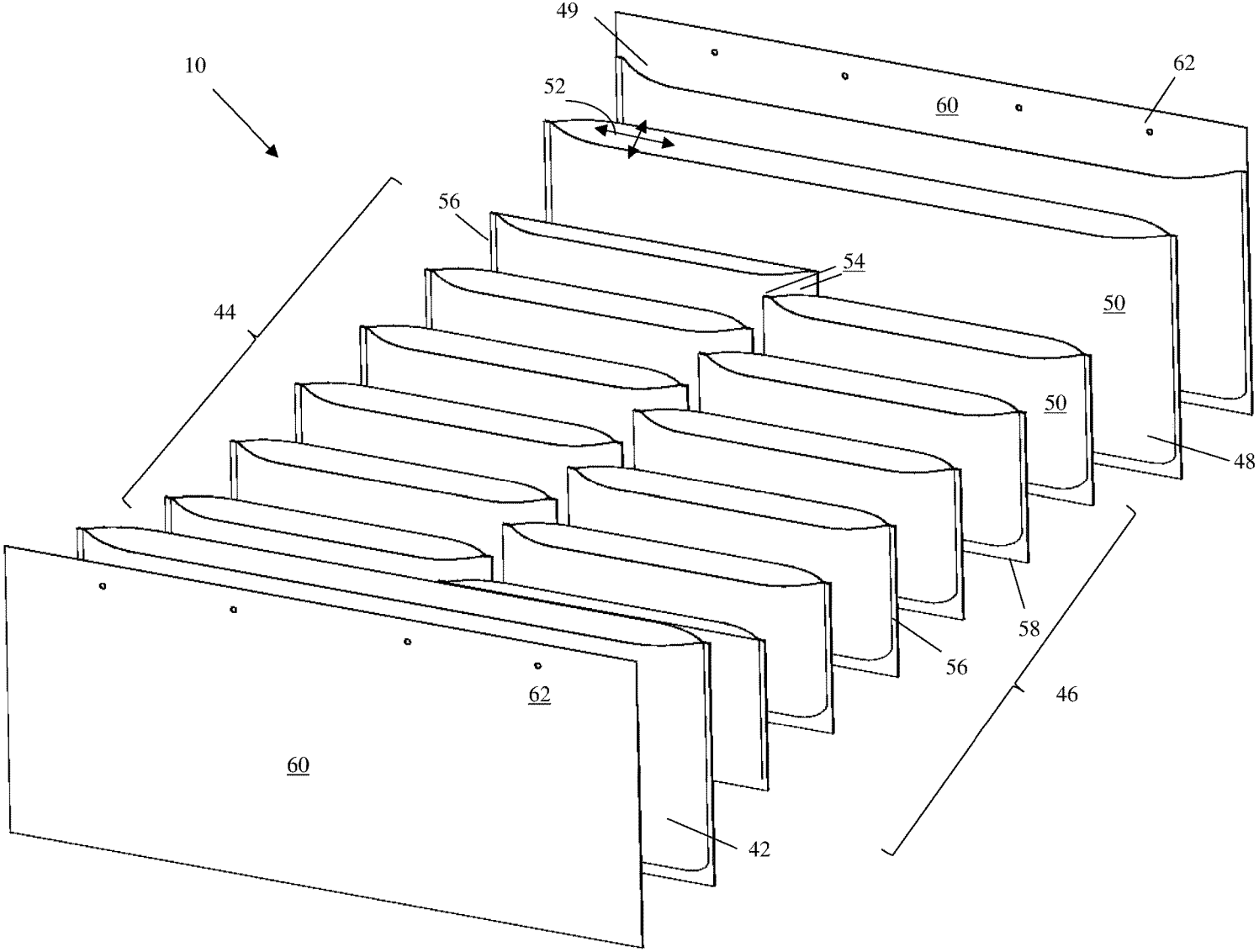
FIG. 7 is an exploded view of the insert assembly demonstrating how the middle half-length pockets are staggered.

Referring to the exploded view of FIG. 7, each pocket comprises: two parallel substantially thin (e.g. 1-3 millimeters) rectangular-shaped flat sidewalls 50 forming an opened top surface 52; an inner side or first seam 54; an outer or second seam 56; and a bottom seam 58. Each pocket sidewall 50 is affixed to an adjoining pocket sidewall to create an accordion effect.

In an embodiment, there are four total full-length pockets: 40, 42, 48, 49. Positioned in between the two pairs (40, 42) and (48,49), are two parallel, staggered rows (44, 46) of half-length pockets, which are fixed in the middle height of the full-length pockets (e.g. see FIGS. 2A, 2B, and 3 where bottom seam 58 of half-length pockets does not reach bottom seam 58 of full-length pockets).

Pulling the assembly's flat opposing right and left end walls 60 straight apart (e.g. FIGS. 5A, 6) or pivoting them apart by pulling only the top edges apart while keeping the bottom edges together (e.g. FIGS. 1-3), will open the pockets. And compressing the stack of pockets (FIG. 5B), e.g. closing a wallet, will securely seal the pockets closed so that the contents cannot spill out of the wallet (e.g. coins, cards, etc.). Because of this compression, a separate coin pocket with a closure (e.g. a zipper) is not required to keep the coins securely stored within a wallet.

As further illustrated in the exploded view of FIG. 7, the opposing ends walls of insert assembly 10 comprise a flat sheet 60 with a higher height (e.g. about one-quarter to one-half inch) than the full-length pockets. End walls 60 further comprise a fixation mechanism or location, such as the four exemplified holes 62 for securing insert assembly 10 to an inside surface 25 of a wallet 20 (e.g. see FIG. 1, 25).

Figure 4:
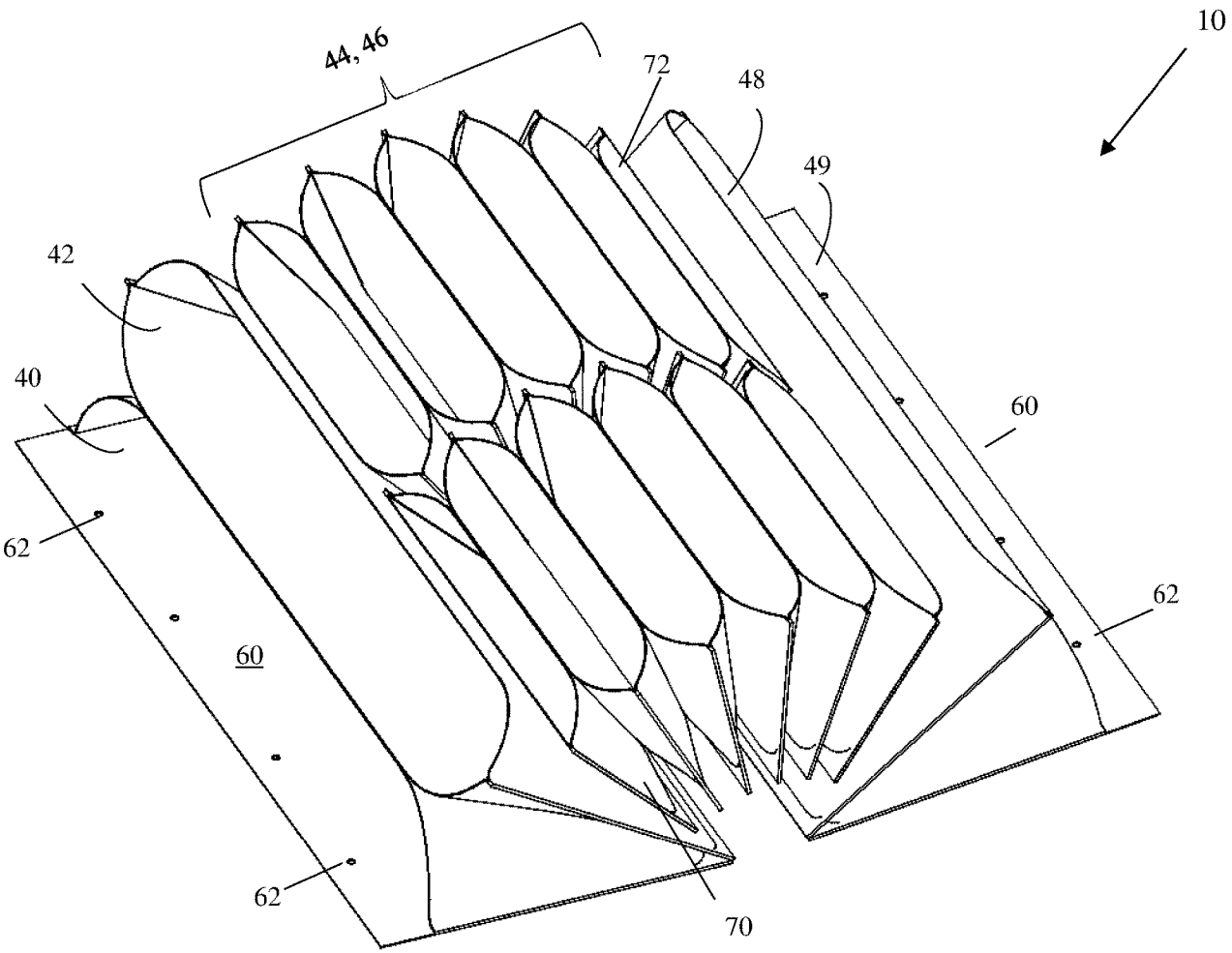
FIG. 4 illustrates a top perspective view of FIG. 3.

In an embodiment, as illustrated in FIG. 4, end walls 60 are joined to a sidewall 50 to form a full-length pocket 40, 49 with half the width, e.g. half the storage volume as compared to the remaining pockets 42, 48. Likewise, half-length pockets 70, 72 comprise half the storage volume as the other pockets in rows 44, 46

In another embodiment, all of the full-length pockets have the same storage volume, and all of the half-length pockets have the same storage volume.

Figure 2B:
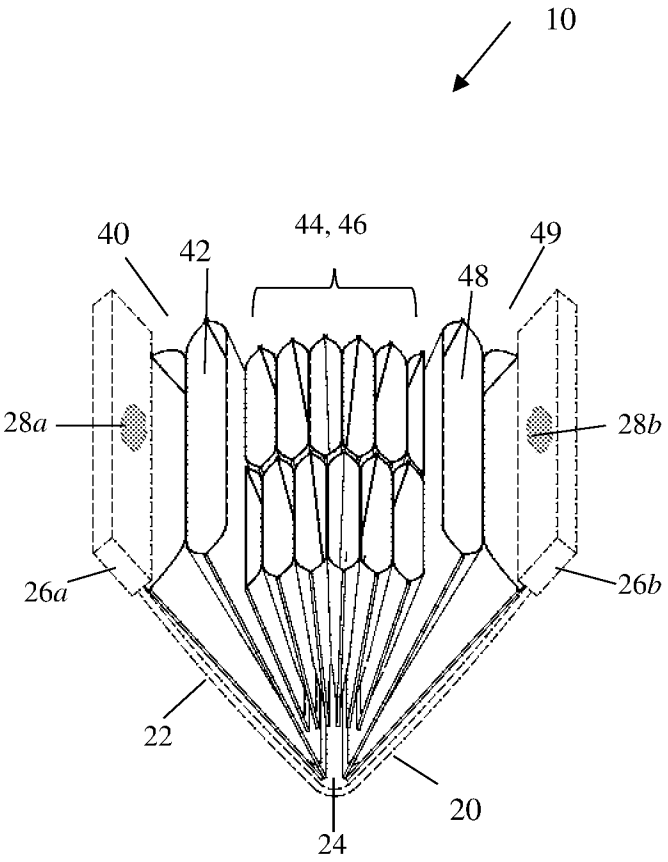
FIG. 2B illustrates a top perspective view of the insert assembly inside of a wallet cover piece in a partially closed position.
Figure 2A:
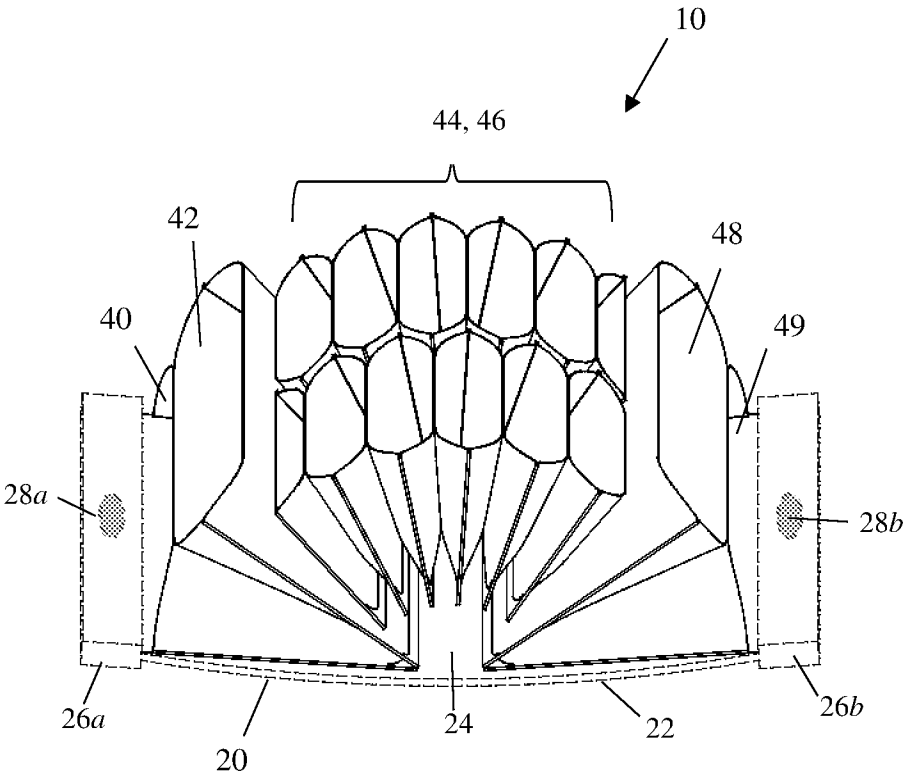
FIG. 2A illustrates a top perspective view of FIG. 1, demonstrating an environment of use by fixing the insert assembly within a flat rectangular wallet.

Bill and Coin Pockets: Assembly 10 comprises a first ($1^{st}$) full-length pocket 40 for storing paper currency, unfolded; and a $2^{nd}$ full-length pocket 42 for storing a plurality of coins. Preferably, bill pocket 40 and the coin pocket 42 are co-located, positioned next to each other to facilitate a user counting out the proper amount of payment quickly, such as when they are standing in a cashier line. In an embodiment, as illustrated in FIGS. 1, 2A, 2B, the front of the wallet with the insert assembly is the bill and coin pockets 40, 42, and the back of the wallet comprises the wallet closing mechanism 28*b* (e.g. a hook 28*b* that fits through a hole 28*a*).

Although the coin pocket 42 is not separately sealable, the coins remain in the pocket unless the wallet is sufficiently tipped or dropped while opened. When the wallet 20 is closed, the coins 32 stay in place no matter the wallet's position. This is accomplished by the top sides of the coin pocket being squeezed together when the wallet is closed; and the depth of pocket 42 being sufficiently deep to store the coins securely when the wallet is opened and the pockets expanded. This unique feature is key to eliminating the zipper normally found on the coin compartment of other wallets, such as on the inside of the wallet or on an outside edge of the cover. When these interior zippered coin compartments are open, the zipper apparatus located at the top opening prevents the pocket from opening wide to allow easy viewing and access. Contrarily, the top of the coin opening in the present invention is unrestricted by a zipper and opens wide to display the coins in an easy to access manner. Thus, the user is not required to dig into the tight wallet pockets, or rummage through a separate coin purse.

Additionally, the user who may initially choose to use cash, can easily see if the amount stored in pockets 40, 42 is insufficient, and instead grab with ease an adjacent debit/credit card 34 from adjoining pocket rows 44, 46. The pockets are wide enough when insert assembly 10 is extended open for a user to insert two fingertips into the top of the pocket to concurrently grab the front and back of a credit card.

Card Pockets: In an exemplary embodiment, the plurality of card pockets is arranged into two staggered, touching rows 44, 46 of pockets with a length about one-half that used for the coin pocket 42 and bill pocket 40. This arrangement allows for two cards to be placed side-by-side, thus allowing for ten to sixteen cards depending on the number of pockets. In the exemplified embodiment of the FIGS. 1-7, there are twelve total half-length pockets.

The vertical height or depth of the half-length pockets in rows 44, 46 are about one-half the height of the full-length pockets 40, 42, 48, 49; and positioned about one-quarter inch (¼) from the top of the assembly and about one-half to three-quarters inches from the bottom of assembly 10. In other words, the half-length pockets are positioned in approximately the middle of the full-length pockets' sidewalls 50 (e.g. see FIG. 5A). The top of cards 34 extend from the top of half-length pockets to be clearly visible, and to approximately align with the top surface of the full-length pockets.

Due to the accordion and pivoting movement of insert assembly 10, the pockets are simultaneously pulled opened and closed. As shown in FIG. 1, cards 34 extend about half an inch above the pocket top surface 50. When the insert is fully extended, there is also about half an inch space between two adjoining cards in the same row (for a total of two rows) to facilitate a user viewing and extracting a card. There are also no restrictive side panels attaching the end covers 60. The connected pockets themselves hold the insert assembly together, thus minimizing the thickness of the insert in a closed wallet.

Extra Pockets: In an additional embodiment, assembly 10 may further comprise one or more extra full-length pockets 48, 49. In an embodiment, at least one third ($3^{rd}$) full-length pocket is positioned on the end of insert assembly 10, opposite bill pocket 40. In another embodiment, insert assembly 10 further comprises a fourth ($4^{th}$) full-length pocket 49 next to pocket 48. These extra pockets may be used, for example, to store: blank checks; shopping receipts; ATM receipts; shopping lists and notes.

Method of Use

In an embodiment, the insert assembly 10 of the present invention is affixed inside of a wallet cover piece 20 using glue, industrial tape, and/or screws.

Wallet Cover Piece: In an embodiment, wallet cover piece 20 is a generally rectangular shaped sheet 20 having a length and a width folded over the array of pockets along the length to define two end covers (like a book cover). Each end cover having a top edge along the width, wherein each end cover is joined at the top edge by a releasable closure (e.g. fixation mechanism 28) that defines the top of the wallet, and an interior face (inner walls) opposing the stack of pockets.

In the exemplary embodiments depicted in FIGS. 1 and 2, dotted lines, wallet cover piece 20 comprises a substantially rectangular shaped flat fabric and/or leather material 22 able to bend in the middle 24 to fold in half. The length sides further comprise a metal or plastic frame 26*a*, 26*b* (e.g. a metal bar running on the edges 26) with a fixation mechanism 28*a*, 28*b* to secure the two frame ends 26*a*, 26*b* together, thus closing the wallet and compressing the pockets within.

In an embodiment, the wallet may have the appearance of a woman's mini-clutch purse, such as when the wallet outer material comprises a decorative fabric, design, material, etc. to allow the wallet with the insert assembly 10 of the present invention to also function as a fashion accessory. In another embodiment, the wallet cover piece 20 comprises an outer material that is made of leather or dark fabric to serve as a man's wallet, which can slide within a jacket inner pocket, a computer or tablet case, a backpack, or a briefcase.

Figure 3:
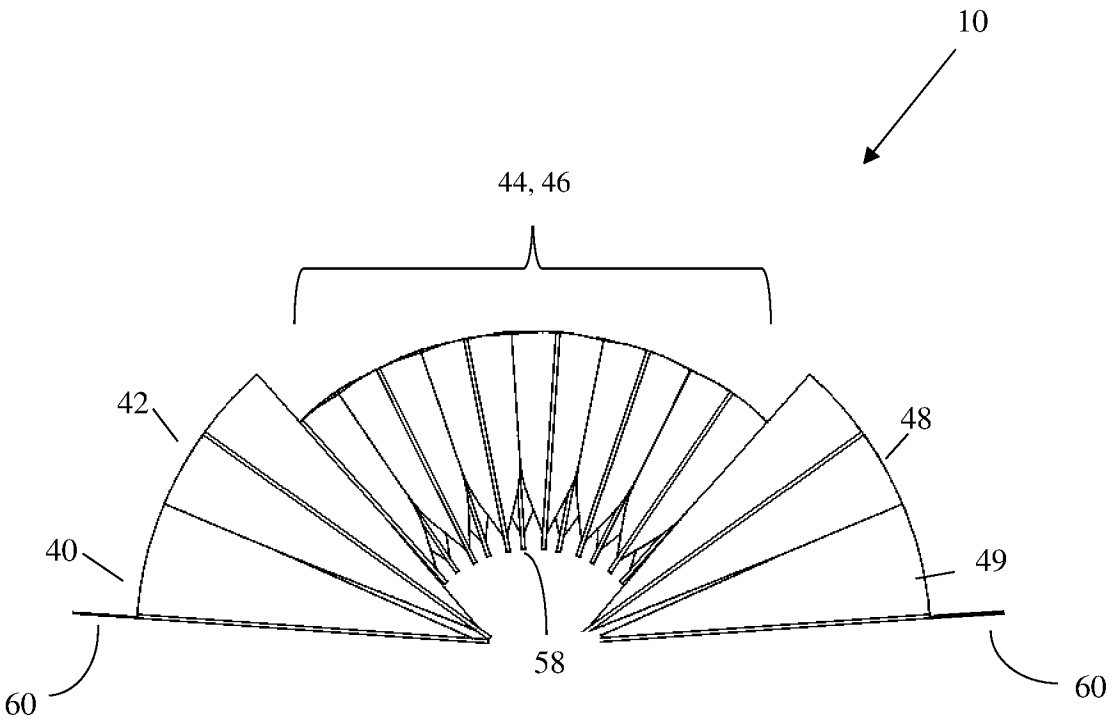
FIG. 3 illustrates a side view of the insert assembly in a pivoted open position, and without a wallet cover piece.

In this embodiment, opening the wallet causes the insert assembly 10 to pivot open to expand the top edge of each pocket, while the pockets' bottom edges stay relatively close together (e.g. FIGS. 1-3). This enables the user to easily view and access the contents while keeping them in a cupped position that can be stably held in one hand while the other hand removes the payment form.

Figure 5B:
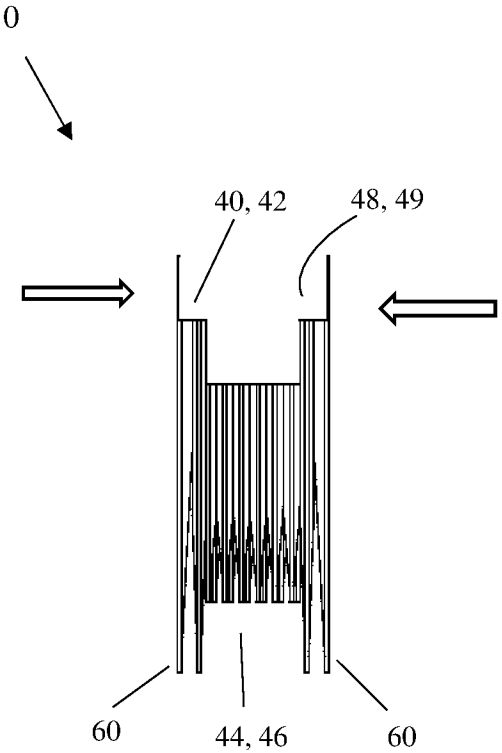
FIG. 5B illustrates a side view of the insert assembly in a closed position with the pockets sealed closed, such as it would be within a wallet cover piece that is snapped shut.
Figure 5A:
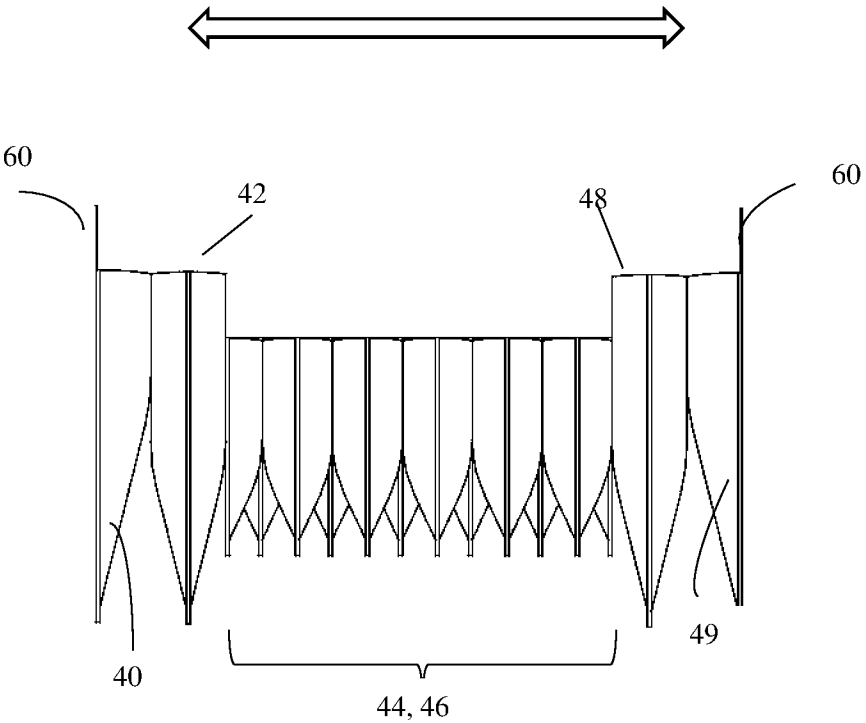
FIG. 5A illustrates a side view of the insert assembly in an extended position.
Figure 6:
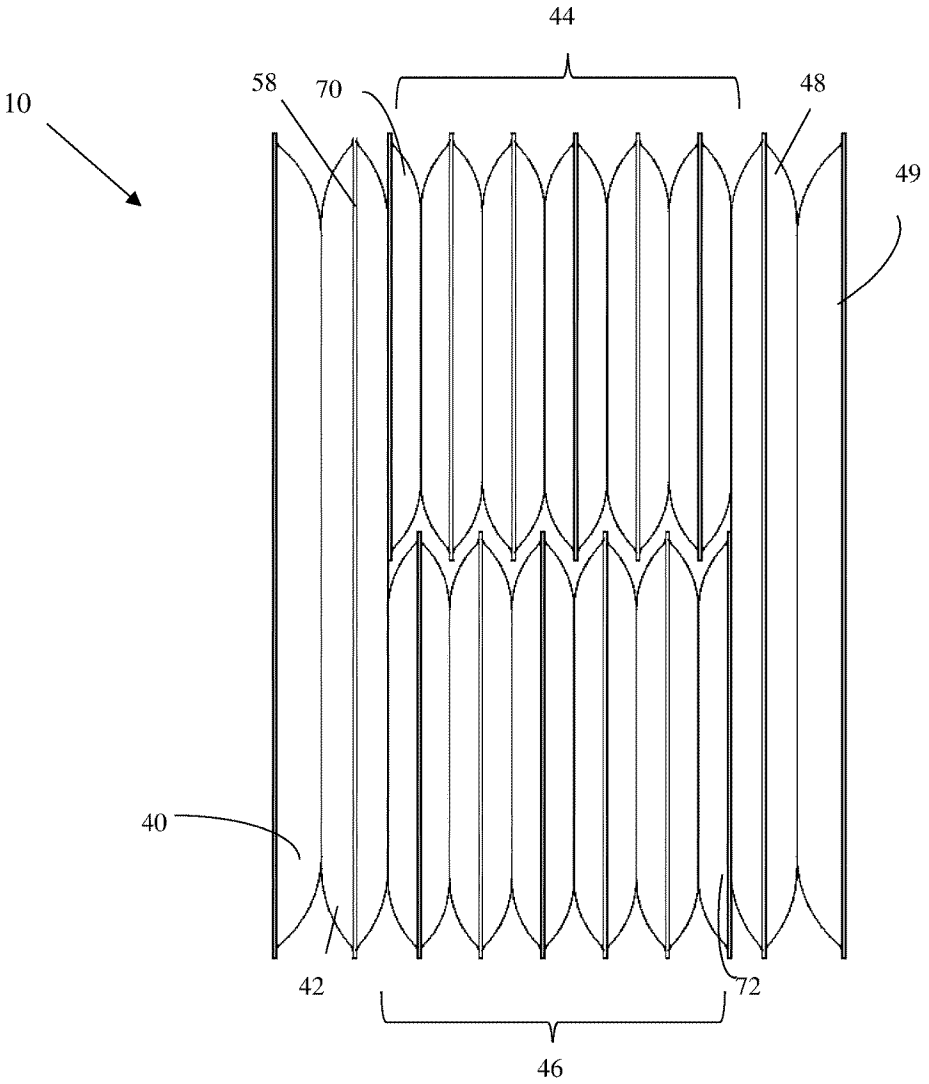
FIG. 6 is a bottom view of the insert assembly showing the seams on each pocket, and how each pocket is attached on their opposing sidewalls to the adjoining pockets.

In another exemplary embodiment as illustrated in FIGS. 5A-5B (only the insert), the wallet cover piece 20 (not shown) instead comprises two substantially rectangular shaped flat fabric and/or leather material, of equal size (e.g. cover 20 cut in half along the width, which equals the two opposing end covers with the stack of pockets in between). One end cover is permanently affixed to one insert end wall. When a user opens the wallet, they pull the opposing end walls 60 apart in a straight line (see FIG. 6), and then close it by pushing them back together. The bottom edge of the opposing end walls 60 that touch when the wallet is closed, may further comprise a material to automatically join the covers together (e.g. magnets); and/or the wallet material may be sufficiently stiff to functionally join the end walls 60 to give the wallet the appearance of being completely sealed when closed (as in the first wallet embodiment of FIGS. 1 and 2). In this embodiment, the pockets are still closed due to the compression at the wallet top edge with the fixation mechanism, which pins the two end walls 60 together. It is also noted that in this embodiment, the pockets are opened even further than about the one-half inch as in the embodiment of FIGS. 1 and 2; thus, allowing the user even more easy access to the cards, cash, and checks stored within.

It is also noted that FIGS. 5A-5B also illustrate the insert assembly of FIGS. 1-3 when it is not fixed within a wallet cover piece 20.

CONCLUSION

It is contemplated that articles, apparatus, methods, and processes of the claimed invention encompass variations and adaptations developed using information from the embodiments described herein. Adaptation and/or modification of the articles, apparatus, methods, and processes described herein may be performed by those of ordinary skill in the relevant art.

Accordingly, the preceding exemplifications merely illustrate the principles of the various embodiments. It will be appreciated that those skilled in the art will be able to devise various arrangements which, although not explicitly described or shown herein, embody the principles of the embodiments and are included within its spirit and scope. Furthermore, all examples and conditional language recited herein are principally intended to aid the reader in understanding the principles of the invention and the concepts contributed by the inventor to furthering the art, and are to be construed as being without limitation to such specifically recited examples and conditions. Moreover, all statements herein reciting principles, aspects, and embodiments of the invention as well as specific examples thereof, are intended to encompass both structural and functional equivalents thereof. Additionally, it is intended that such equivalents include both currently known equivalents and equivalents developed in the future, i.e., any elements developed that perform the same function, regardless of structure. The scope of the various embodiments, therefore, is not intended to be limited to the exemplary embodiments shown and described herein.

The technology illustratively described herein suitably may be practiced in the absence of any element(s) not specifically disclosed herein. Thus, for example, in each instance herein any of the terms "comprising," "consisting essentially of," and "consisting or" may be replaced with either of the other two terms. The terms and expressions which have been employed are used as terms of description and not of limitation, and use of such terms and expressions do not exclude any equivalents of the features shown and described or portions thereof, and various modifications are possible within the scope of the technology claimed. The term "a" or "an" can refer to one of or a plurality of the elements it modifies (e.g., "a reagent" can mean one or more reagents) unless it is contextually clear either one of the elements or more than one of the elements is described.

The term "about" as used herein refers to a value within 10% of the underlying parameter (i.e., plus or minus 5%), and use of the term "about" at the beginning of a string of values modifies each of the values (i.e., "about 1, 2 and 3" refers to about 1, about 2 and about 3).

Thus, it should be understood that although the present technology has been specifically disclosed by representative embodiments and optional features, modification and variation of the concepts herein disclosed may be resorted to by those skilled in the art, and such modifications and variations are considered within the scope of this technology.

As used herein, the term "substantially" refers to approximately the same shape as stated, and recognizable by one of ordinary skill in the art.

Trademarks: the product names used in this document are for identification purposes only; and are the property of their respective owners.

The disclosure set forth herein of certain exemplary embodiments, including all text, drawings, annotations, and graphs, is sufficient to enable one of ordinary skill in the art to practice the invention. Various alternatives, modifications and equivalents are possible, as will readily occur to those skilled in the art in practice of the invention. The inventions, examples, and embodiments described herein are not limited to particularly exemplified materials, methods, and/or structures and various changes may be made in the size, shape, type, number and arrangement of parts described herein. All embodiments, alternatives, modifications and equivalents may be combined to provide further embodiments of the present invention without departing from the true spirit and scope of the invention.

In general, in the following claims, the terms used in the written description should not be construed to limit the claims to specific embodiments described herein for illustration, but should be construed to include all possible embodiments, both specific and generic, along with the full scope of equivalents to which such claims are entitled. Accordingly, the claims are not limited by the disclosure.

What is claimed is:

1. A pocket insert assembly able to be fixed within a wallet, the insert comprising:

an array of pockets arranged in an accordion-like, linear formation with a plurality of full-length pockets, and two rows of half-length pockets;

each pocket comprising two thin substantially rectangular shaped sidewalls joined to form an opened top surface, two side seams, a bottom seam; and each pocket sidewall affixed to an adjoining pocket sidewall;

wherein the insert assembly in an expanded position stretches each pocket opened to concurrently display a contents stored within; and wherein the insert assembly in a closed position is able to compress the pocket sidewalls together to securely store the contents within.

2. The pocket insert assembly of claim 1, wherein the contents comprise one or more of: paper currency, coins, credit and debit cards, gift cards, blank checks, picture identification card; passport card; driver's license; store cards; membership cards; sales receipts; and shopping lists.

3. The insert assembly of claim 1, wherein the array of pockets, comprises: a first full-width pocket; a second full-width pocket adjoined to the first full-length pocket; and a plurality of half-width pockets arranged into two parallel, staggered rows.

4. The insert assembly of claim 3, wherein the first full-length pocket is able to store a plurality of paper currency unfolded; and the second full-length pocket is able to stably store a plurality of coins; and a user is able to quickly count out a cash payment or select a card for payment.

5. The insert assembly of claim 3, further comprising a third full-length pocket, wherein the first and second full-length pockets are positioned on one end of the array and the third full-length pocket is positioned on an opposing array end, and the two rows of half-width pockets are positioned in-between.

6. The insert assembly of claim 5, further comprising a fourth full-length pocket adjoining the third full-length pocket.

7. The insert assembly of claim 5, wherein the two rows of half-width pockets are staggered, with each pocket inner side seam positioned between parallel adjoined pockets.

8. The insert assembly of claim 1, wherein each of an opposing end of the array of pockets comprises a flat opposing end wall able to be affixed inside of a wallet cover piece.

9. The insert assembly of claim 8, wherein the insert assembly fixed within the wallet cover piece is able to pivot open in a curved accordion-like fashion to stretch the full-length and the half-length pockets sufficiently wide to enable a user to insert finger tips to remove content.

10. The insert assembly of claim 1, wherein the assembly comprises a plastic or stiff fabric material; transparent, opaque, or colored; and able to be affixed inside of a wallet cover piece.

11. The insert assembly of claim 1, wherein the full-length pockets are about 7 inches in length and about 3 inches in depth; and the half-length pockets are about 3 and ¾ inches in length, and about 1 and ¾ inches in depth.

12. A method of using a pocket insert assembly, comprising:

a) providing an insert assembly comprising, an array of pockets arranged in an accordion-like, linear formation with a plurality of full-length pockets, and two rows of half-length pockets;

each pocket comprising two thin substantially rectangular shaped sidewalls, joined to form an opened top surface, two side seams, a bottom seam; and each pocket sidewall affixed to an adjoining pocket sidewall;

wherein the insert assembly in an expanded position stretches each pocket opened to concurrently display a contents stored within;

wherein the insert assembly in a closed position is able to compress the pocket sidewalls together to securely store the contents within;

b) affixing the insert assembly within a wallet cover piece comprising a substantially rectangular shaped stiff material, folded in half, with a fixation mechanism able to secure a wallet two opposing ends together;

c) storing a plurality of the contents within the array of pockets;

d) pivoting opening the wallet cover piece to concurrently display the contents, wherein a user extracts one or more of the contents by inserting a user's fingertips into the pockets; and e) closing the wallet cover piece by securing the fixation mechanism, wherein the array of pockets is compressed to securely store the contents.

13. The method of claim 12, wherein the contents comprise one or more of: paper currency, coins, credit and debit cards, gift cards, blank checks, picture identification card; passport card; driver's license; store cards; membership cards; sales receipts; and shopping lists.

14. The method of claim 12, wherein the array of pockets, comprises: a first full-width pocket; a second full-width pocket adjoined to the first full-length pocket; and a plurality of half-width pockets arranged into two parallel, staggered rows.

15. The method of claim 14, wherein the first full-length pocket stores a plurality of paper currency unfolded; and the second full-length pocket stably stores a plurality of coins; and a user is able to quickly count out a cash payment or select a card for payment.

16. The method of claim 14, further comprising a third full-length pocket, wherein the first and second full-length pockets are positioned on one end of the array and the third full-length pocket is positioned on an opposing array end, and the two rows of half-width pockets are positioned in-between.

17. The method of claim 16, further comprising a fourth full-length pocket adjoining the third full-length pocket.

18. The method of claim 14, wherein the two rows of half-width pockets are staggered with each pocket inner side seam positioned between parallel, adjoined pockets.

19. The method of claim 15, wherein each of an opposing end of the array of pockets comprises a flat opposing end wall able to be affixed inside of a wallet cover piece.

20. The method of claim 12, wherein the insert assembly comprises a plastic or stiff fabric material; transparent, opaque, or colored.

* * * * *